United States Patent [19]

Taylor

[11] 4,427,040

[45] Jan. 24, 1984

[54] REVERSE FLOW POP-OFF AIR CONTROL

[76] Inventor: Murland L. Taylor, 5300 Main, Parsons, Kans. 67357

[21] Appl. No.: 19,757

[22] Filed: Mar. 12, 1979

[51] Int. Cl.[3] ..... B65B 1/04

[52] U.S. Cl. ..... 141/67; 141/119

[58] Field of Search ..... 141/67, 68, 10, 115, 141/116, 119; 406/146; 222/108

[56] References Cited

U.S. PATENT DOCUMENTS

| | | | |
|---|---|---|---|
| 2,650,003 | 8/1953 | Coleman | 141/119 X |
| 3,014,620 | 12/1961 | Moore | 141/119 X |
| 3,072,208 | 1/1963 | Titchenal et al. | 141/68 X |
| 3,895,748 | 7/1975 | Klingenberg | 141/119 X |
| 3,900,055 | 8/1975 | Henry | 141/67 |

*Primary Examiner*—Harry N. Haroian

*Attorney, Agent, or Firm*—Robert E. Breidenthal

[57] ABSTRACT

A pneumatic valve bag packer provided with an air feed to the hopper that includes an eductor pump having its inlet connected to the hopper so as to produce a subatmospheric pressure in the hopper and consequent reverse air flow in the filling spout when the discharge of the eductor pump is open. The arrangement is such that the closure of the pump discharge by a valve provided for this purpose will result in superatmospheric pressure in the hopper suitable for bag filling. Abrupt opening of the pump discharge causes a vacuum pulse within as well as a sustained low pressure in the hopper so as to promptly stop and prevent material dribble from the filling spout.

9 Claims, 7 Drawing Figures

REVERSE FLOW POP-OFF AIR CONTROL

The present invention relates to new and useful improvements in pneumatical valve bag packers, and more particularly pertains to means for stopping all discharge of material from the filling spout during the intervals between the successive filling of bags. More specifically, the invention involves effecting the desired stoppage by inducing a reverse air flow through the filling spout during the intervals.

Pneumatic valve bag packers are such that a valve bag into which a filling spout of the packer is inserted will receive material or product from an air pressurized hopper through such spout. Air within the hopper flows with and propels product into the bag. Automatic packers sense the filling of a bag by scales and thereupon turn off the flow of product, and remove the filled bag from the spout, with the packer then being in readiness for placement of an empty bag on the spout followed by resumption of the flow of product.

Unfortunately, with many packers, the turn off of a flow of product is incomplete and a dribble of product from the discharge end of the filling spout occurs after the filled bag is removed with some kinds of products, any dribble or such product is totally unacceptable and consequently such packer cannot be used in connection with such kinds of products. In any event, dribble is unsightly, the dust produced therefrom can be ecologically damaging and a health hazard can impair the footing and result in a worker being injured in a fall, and is otherwise generally undersirable.

Pneumatic valve bag packers have been heretofore proposed for stopping the discharge of material during the intervals between the successive filling of bags and some have done a reasonably good job of effecting the desired stoppage, but are not free of certain shortcomings. For example, the use of valves or pinch-off devices in the fill lines can crush, pinch, break or otherwise damage the material, and such damage of the material or product being packed into the bag in the case of some kinds of material or product be in and of itself more undesirable than the dribble or discharge that would otherwise occur during the desired stoppage intervals.

With such other proposals that effect a positive shut off, another complication arises in that pressurized air is trapped in the hopper with the result that such other proposals require the provision of valved means provision of valved means for bleeding excess air from the hopper so that recharging of material into the hopper from the supply bin can commence.

It is the paramount objective of the present invention to provide a pneumatic valve bag packer such that the discharge of product is stopped without damage to the product during the intervals between successive bag fillings.

It is another important objective to provide a packer in accordance with the preceding objective that will not require the provision of valved air bleeding means for enabling recharging of the hopper from the bin to commence.

Still another important objective of the present invention is to provide a packer such that the desired discharge and bleeding mentioned in the foregoing objectives can be alternately effected respectively upon alternately closing and opening a single valve.

Broadly, the present invention involves a pneumatic valve bag packer of the class wherein material and air flow into a bag being filled through a filling spout from an air pressurized hopper containing the material, and wherein flow curtailing means are provided for curtailing the flow of material through the discharge end of the spout upon completion of the filling of a bag and its removal from the discharge end of the spout; the improvement comprising said flow curtailing means comprising an air flow control means for causing a reversed flow of air in the spout sufficient to stop discharge of material through the discharge end of the spout.

Other objectives, aspects, features and advantages of the invention will become apparent as the following description of a preferred embodiment of the same proceeds, such description being given in conjunction with the accompanying drawings illustrative thereof, wherein.

Figure 1:
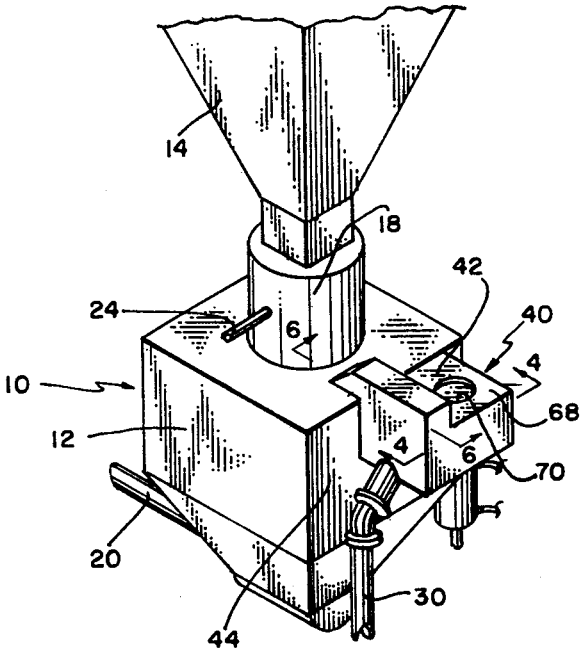
FIG. 1 is an isometric view of the improved packer, with the supply bin therefor and its outlet valve means being only partially shown, and with the air supply lines to the air control housing and to the pneumatic valve actuator cylinder being broken away.
Figure 2:
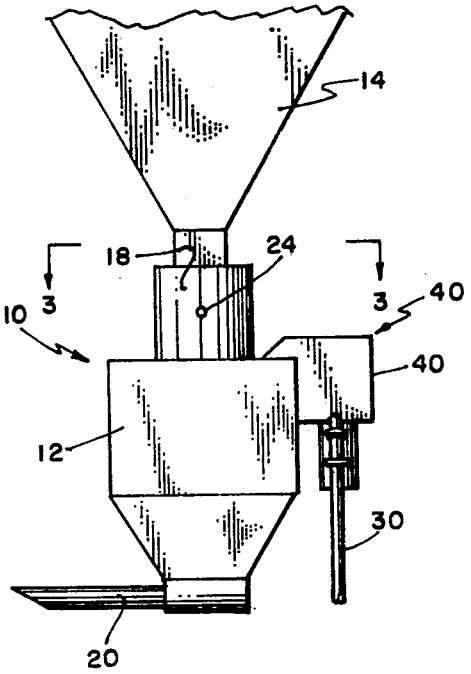
FIG. 2 is a side elevational view of the structure shown in FIG. 1.
Figure 3:
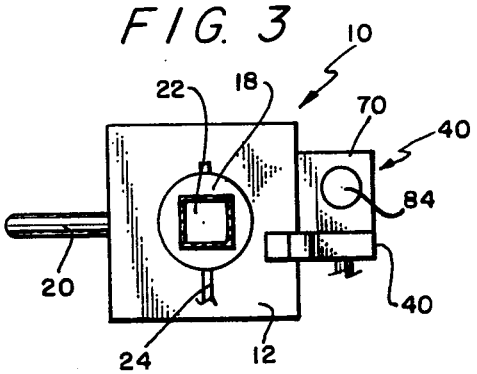
FIG. 3 is a top plan view of the packer taken from a section through the conduit connecting the supply bin to the hopper of the packer.
Figure 4:
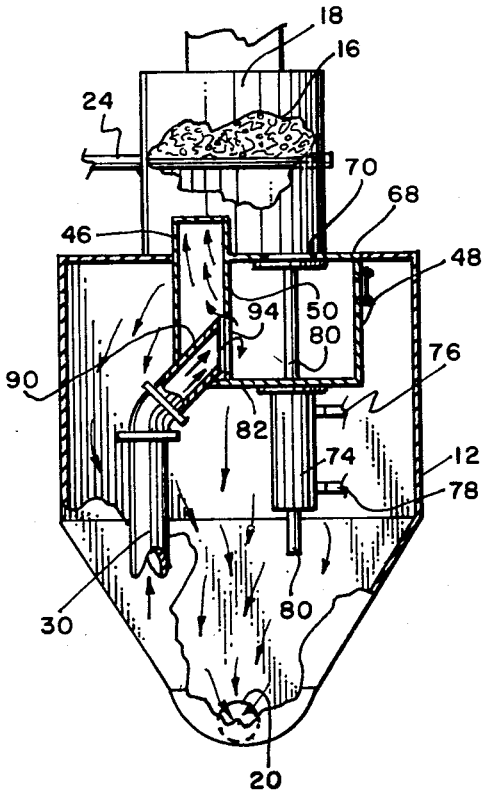
Figure 5:
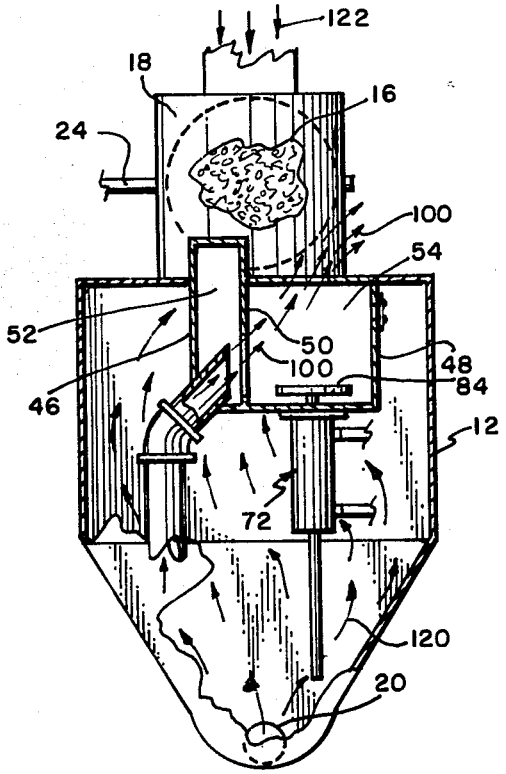
Figure 6:
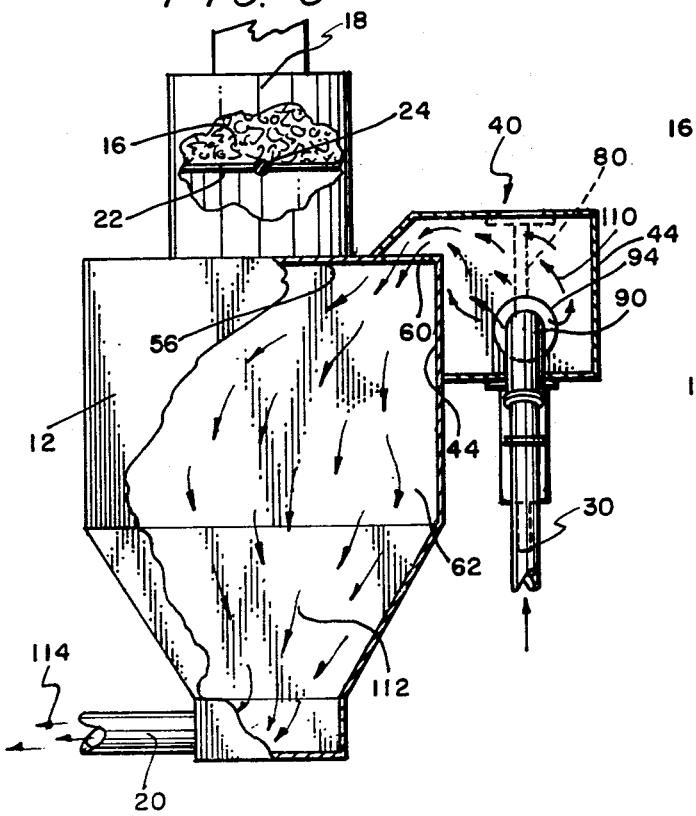
Figure 7:
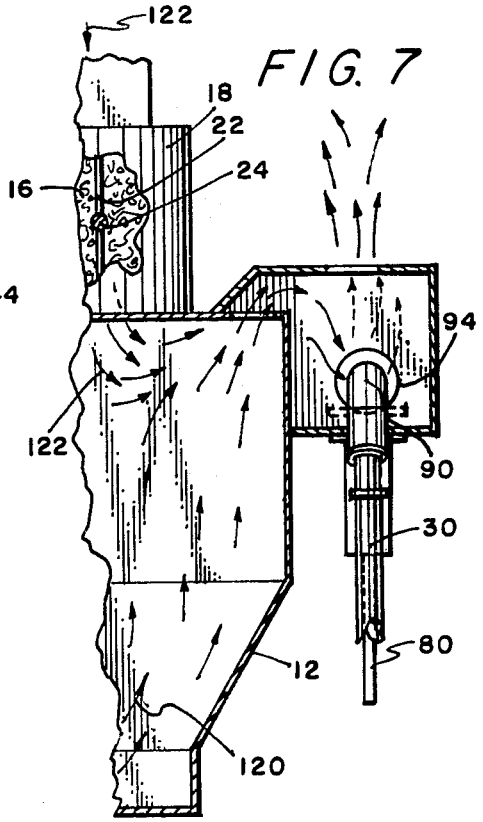

FIGS. 4 and 5 are rear elevational views of the packer, such views being largely in section upon the plane of the section line 4—4 in FIG. 1, and with parts broken away to reveal hidden interiors, such figures respectively showing by arrows air flows and relationship of parts during bag filling and intermediate bag fillings while the hopper is being recharged from the bin; and, FIGS. 6 and 7 are side elevational views largely in section upon the section lines 6—6 in FIG. 1, with such figures corresponding respectively to the depictions of FIGS. 4 and 5.

Referring now to the drawings wherein like numerals designate like parts throughout the various views, the reference numeral 10 designates the pneumatic valve bag packer generally comprised of a packer hopper 12 disposed below a supply bin 14 from which it is charged with a product 16 through a valved conduit 18. The contents of the hopper 12 are pneumatically discharged through a bag filling spout 20 that extends horizontally from the bottom of the hopper 12.

A butterfly valve 22 within the conduit 18 and mounted on a shaft 24 journaled through the side of the conduit is operable upon appropriate turning of the shaft 24 to open and close the conduit 18. As the valve 22 does not in and of itself constitute inventive subject matter herein, it will be suffice to say that the same is conventional and such as to close without significant pinching or damaging of the product 16 and at the same time effect a closure such as to prevent significant air flow through the conduit 18 during certain phases of packer operation subsequently to be described.

The pneumatic discharge of product 16 from the hopper 12 through the filling spout 20 is under the influence of air introduced into the hopper 12 via an air pipe 30 that is connected to a source of pressurized air, not shown.

The packer 10 as thus far described is entirely conventional and is associated with conventional automatic control means that are not shown as illustration and description of such automatic control means would serve no useful purpose and serve only to obfuscate the present invention insofar as those of ordinary skill in the art are concerned. Suffice to say, such automatic control means customarily include means for sensing, usually by weighing, when a bag is filled, and upon sensing such condition remove the filled bag from the spout 20. Such operation is followed by placing an empty bag on the spout 20. Furthermore, such automatic control means include some sort of provision for initiating the discharge of product 16 through the filling spout 20 after an empty bag is placed on the latter, and such provision customarily includes closing the valve 22 and pressurizing the interior of the hopper 12 from the pipe 30. Furthermore, such automatic control means includes some sort of a provision for terminating discharge through the spout 20 after a bag has been filled and until an empty bag is placed thereon, with some provision being made during this interval to open the valve 22 for recharging the hopper 12 with product 16.

It is again pointed out that the structure thus far described as well as its coaction with automatic control means is conventional and does not constitute per se the subject matter of the present invention. Details of structure and its functional capability of coacting with conventional control means are hereinafter set forth and constitute departures from the teaching of the prior art characterizing the present invention.

The present invention is primarily concerned with the provision of means, presently to be described in detail, for directing air from the pipe 30 into the hopper 12 during the time intervals that a bag is being filled by the spout 20, it being noted that during such time intervals the valve 22 is closed. This phase of desired operation is shown in FIGS. 4 and 6. The present invention is also concerned with abruptly reducing the pressure in the hopper 12, upon a bag becoming filled, sufficiently to cause a reverse flow of air in the spout 20 (so air enters the hopper 12 through the spout 20) and to maintain a subatmospheric pressure within the hopper 12 until an empty bag replaces the filled bag on the filling spout 20, so that a sharp and complete stoppage of product discharge from the spout 20 is accomplished and is maintained until the empty bag is on the spout 20, and so that the recharging of the hopper 12 with product 16 from the bin 14 is pneumatically assisted on opening of the valve 22. Such means are designated generally at 40 and comprises an air control box or housing 42 to one side and at the top of a side wall 44 of the hopper 12, which it shares in common.

The housing 42 has two adjoining sections 46 and 48, and the interiors of such sections 46 and 48 are separated by a vertical partition wall 50 separating chambers 52 and 54.

The housing section 46 extends upwardly to a height above the top of the housing section 48 as well as the top wall 56 of the hopper 12. Indeed, the housing section 46 overlies a portion of the top wall 56 and shares the same in common width of the hopper 12 as evident on inspection of FIGS. 6 and 7. The portion of the top wall 56 shared in common by the hopper 12 and the housing section 46 is provided with an opening 60 that affords fluid communication between the chamber 52 and the interior 62 of the hopper 12 as best shown in FIGS. 6 and 7.

The housing section 48 includes a horizontal top wall 68 that is provided with a large central outlet opening 70, and pneumatically powered valve means 72 is provided for closing and opening the outlet opening 70. Such means comprises a double-acting pneumatic cylinder 74 disposed below the housing section 48 that is provided with air hoses 76 and 78 for respectively actuating downward and upward movement of a piston rod 80 that is slidingly and sealingly vertically reciprocable through a bottom wall 82 of the housing section 48. A circular plate or valving element 84 is fixed to the upper end of the piston rod 80 for vertical reciprocating motion within the chamber 54. In its uppermost position, the valve element 84 seats against the wall 68 about the opening 70 so as to close the latter as shown in FIG. 4, and in its lowermost position, the valve element 84 is closely spaced above the bottom wall 82 as shown in FIG. 5. For reasons subsequently to be explained, it is important to note that the means 72 can be actuated to move very rapidly from the opening closing position shown in FIG. 4 to the opening opening position shown in FIG. 5, whereby any superatmospheric pressure within the chamber 54 can be very rapidly released to escape through the large outlet opening 70.

As shown in FIGS. 1, 4 and 5, the pipe 30 is provided at its upper end with a vertically inclined discharge nozzle section 90 that sealingly projects into the housing 40 to terminate within the lower portion of the chamber 52. As clearly shown in FIGS. 4 and 5, the discharge end of the nozzle 90 terminates in a vertical plane spaced a short interval from the vertical plane of the partition wall 50. The partition wall 50 is provided with an eduction opening 94 that is in alignment with the axis of the nozzle 90. Preferably, the nozzle 90 is circular in transverse section, and has inside dimensions smaller than those of the eduction opening 94. The eduction opening 94 can be circular, however, if deemed necessary or expedient, the same can be of elliptical form and essentially be an enlarged projection of the circular nozzle internal configuration upon the plate 50.

It will be noted that the vertical inclination of the nozzle 90 and its spatial relationship to the opening 70 is such that when the latter is open, air discharged from the nozzle 90 proceeds in virtually a straight line through the opening 94 and through the opening 70 as shown in FIG. 5, it being noted that the valve element 84 is disposed well below such path of air movement so as not to interfere therewith.

When the valve means 72 is open and air is discharged from the nozzle 90 as depicted by the arrows 100 in FIG. 5, the apparatus functions as an eductor pump in that air is withdrawn from the chamber 52 (and thence also from the interior 62 of the hopper) and moved into the chamber 52 with the air discharged from the nozzle 90. Indeed, air within the chamber 54 is also entrained with the air discharged by the nozzle 90 so as to exit along with the latter from the chamber 54 through the opening 70.

With an appreciation of the function of the air control means 40 as an eductor pump as described above, the complete operation of the packer 10 will be readily understood. As a starting point, it will be assumed that a bag is disposed on the spout 20 and is in the process of being filled, and in which case it will be understood that the valve 22 is closed. During such bag filling interval, the means 72 is operated to maintain the opening 70 closed as shown in FIG. 4. With the opening 70 closed, air entering the housing 42 through the nozzle 90 is constrained to have pressure and flow communication solely with the interior 62 of the hopper 12 through the opening 60, whereby the interior 62 is pressurized to a superatmospheric pressure, and thereby functions to pneumatically facilitate the discharge of product within the hopper 12 through the spout 20 as indicated by the arrows 110, 112 and 114. It can be noted at this point that the nozzle 90 has continuous pressure and flow communication via the pipe 30 with whatever source of pressurized air that the latter is connected. In other words, the operation of the packer 10 does not require the provision of any valve means in the pipe 30, and indeed a continuous connection of the nozzle 90 to a source of pressurized air is desired.

After the bag has become full and immediately prior to the filled bag being removed from the spout 20, pneumatic means 72 is actuated to effect a very quick or abrupt opening of the opening 70. Upon such sudden opening of the opening 70, there is a sudden outrush of air or pop-off of air through the opening 70 from the chambers 52 and 54, as well as the interior 62 of the hopper 12 as to produce a vacuum pulse therein that in turn results in an abrupt reversal of air flow in the spout 20. Such abrupt reversal of air flow in the spout 20 causes an immediate and complete cut off of discharge of product 16 from the spout 20, whereupon the filled bag can be removed without any dribble of product from the spout 20, it being understood that the opening 70 is kept open so as to continue eductor pump operation until an empty bag has been placed on the spout 20 to replace the previously filled bag.

It is believed that a vacuum pulse occurs on abrupt opening of the opening 70 by reason of the inertia of air exiting the housing 42, with the abrupt opening facilitating attainment of optimum exiting velocity.

In the operation of the means 40 in performing the eductor pumping function, it is believed the pumping action occurs by reason of entrainment of air in the chamber 52 (and air also in the chamber 54) by the stream of air discharged by the nozzle 90, and that the pumping function is also due to, primarily perhaps due to, the venturi effects occuring about the stream of air discharged by the nozzle 90.

During the time interval that the opening 70 is open, the shaft 24 can be turned to open the valve 22, so that the eductor pump action not only causes the air flow shown by the arrows 120 (which flow is associated with reverse air flow in the spout 20), but also draws air downwardly from within the bin 14 as indicated by the arrows 122 to enhance pneumatically recharging the hopper 12 from the bin 14. The air flows 120 and 122 exit together in the air stream 100.

After an empty bag has been placed on the spout 20, the valves 22 and 72 are closed, preferably in a timed sequence in the order named, whereupon the filling of the emtpy bag is commenced. As the closing of the valve 22 prior to the closing of the valve 72 is preferred, it is also preferred that the opening of the valve 72 precede the opening of the valve 22 for a time sufficient for the vacuum pulse to have reversed the direction of flow in the spout 20.

Control of the means 72 and the valve 22 can be manually effected by manual means, not shown, however, such is not preferred and is automatically effected by means not shown, synchronized by the sensing of a bag becoming full and the placement of an empty bag on the spout 20 having been effected. As such automatic control and synchronizing means are not essential to either the operation or understanding of the present invention, such means are neither illustrated nor described beyond this brief illusion thereto.

Having fully described the improved packer and its operation, attention is now directed to the appended claims for an understanding of the actual scope of the invention.

I claim:

1. In a pneumatic valve bag packer of the class wherein material and air flow into a bag being filled through a filling spout from the interior of an air pressurized hopper containing the material, and wherein flow curtailing means are provided for curtailing the flow of material through the discharge end of the spout upon completion of the filling of a bag and its removal from the discharge end of the spout; the improvement comprising said flow curtailing means comprising an air flow control means for causing a reversed flow of air in the spout sufficient to stop discharge of material through the dischage end of the spout, said air flow control means comprising means for withdrawing sufficient air from the hopper to result in a subatmospheric air pressure therein, and a reversed flow of air in the spout.

2. The combination of claim 1, wherein the air control means includes an eductor pump.

3. In a pneumatic valve bag packer of the class wherein material and air flow into a bag being filled through a filling spout from the interior of an air pressurized hopper containing the material, and wherein flow curtailing means are provided for curtailing the flow of material through the discharge end of the spout upon completion of the filling of a bag and its removal from the discharge end of the spout; the improvement comprising said flow curtailing means comprising an air flow control means for causing a reversed flow of air in the spout sufficient to stop discharge of material through the discharge end of the spout, said air flow control means comprising means for withdrawing sufficient air from the hopper to result in a subatmospheric air pressure therein, whereby a reversed flow of air is induced in the spout, said air flow control means including an eductor pump having inlet and outlet ports together with a working fluid inlet adapted to be connected to a source of pressurized air, means affording fluid communication between the interior of the hopper and the inlet port of the pump, and means for selectively opening and closing the outlet port of the pump, whereby the pump operates when the outlet port is open to pump air from the hopper with such air and air entering the pump through the working fluid inlet being exhausted through the outlet port, and whereby air entering the pump through the working fluid inlet has pressure communication with the interior of the hopper through the inlet port when the outlet port is closed.

4. The combination of claim 3, including a material supply bin disposed above the hopper, a valve controlled passageway connecting the bin and the hopper for gravity feed of material to the hopper when the valve controlled passageway is open, said valve controlled passageway being normally closed when a bag is being filled, means for opening said valve controlled passageway when the pump outlet port is open, whereby ambient air can enter the hopper along with material from the bin when a subatmospheric pressure prevails in the hopper to facilitate the gravity movement of material into the hopper.

5. In a pneumatic valve bag packer of the class wherein material and air flow into a bag being filled through a filling spout from the interior of an air pressurized hopper containing the material, and wherein flow curtailing means are provided for curtailing the flow of material through the discharge end of the spout upon completion of the filling of a bag and its removal from the discharge end of the spout; the improvement comprising said flow curtailing means comprising an air flow control means for causing a reversed flow of air in the spout sufficient to stop discharge of material through the discharge end of the spout, said air control means comprising a housing having a partition therein separating the interior thereof into first and second chambers, said housing having an outlet opening that opens into the second chamber, valve means for selectively opening and closing said outlet opening, said housing having a second opening that opens into the first chamber, means affording air communication between the hopper and the first chamber through said second opening, said partition having an eductor opening therethrough, means including a discharge nozzle for introducing air from a pressurized source thereof into the housing, said nozzle being disposed to discharge air from a position in the first chamber toward the eductor opening, with the relative geometries and spacing of the eductor opening and the nozzle being such that discharging air from the nozzle when the outlet opening is open will educt air from the first chamber and produce a subatmospheric pressure therein, and whereby such discharge of air from the nozzle will result in a superatmospheric pressure in the first chamber when the outlet opening is closed.

6. The combination of claim 5, wherein the same is so constructed and arranged that an abrupt opening of the outlet opening will promptly produce a subatmospheric pressure pulse in the hopper and result in immediate reversal of air flow in the spout, and wherein said valve means are power operated for effecting an abrupt opening of the outlet opening.

7. The combination of claim 6, wherein said valve means comprises a piston rod mounted for slidingly and sealingly reciprocating through the housing and projecting from within the second chamber to space external of the housing, a valving element disposed within the second chamber and fixed to the piston rod for respectively closing and opening the outlet opening on reciprocation of the piston rod, and a double-acting pneumatic cylinder operatively connected to the piston rod.

8. In a pneumatic valve bag packer of the class wherein material and air flow into a bag being filled through a filling spout from the interior of an air pressurized hopper containing the material, and wherein flow curtailing means are provided for curtailing the flow of material through the discharge end of the spout upon completion of the filling of a bag and its removal from the discharge end of the spout; the improvement comprising said flow curtailing means comprising an air flow control means for causing a reversed flow of air in the spout sufficient to stop discharge of material through the discharge end of the spout, said air flow control means comprising means for effecting a sufficient reduction in air pressure within the hopper to result in a reversed flow of air in the spout.

9. The combination of claim 8, wherein said air flow control means comprises an eductor pump having inlet and outlet ports together with a working fluid inlet adapted to be connected to a source of pressurized air, means affording fluid communication between the interior of the hopper and the inlet port of the pump, and valve means for selectively closing the outlet port of the valve, whereby air may be selectively forced into and educted from the interior of the hopper through the inlet port of the pump on the valve means respectively being open and closed.

* * * * *